United States Patent [19]

Jones et al.

[11] Patent Number: 4,574,760

[45] Date of Patent: Mar. 11, 1986

[54] FUEL INJECTION THROTTLE BODY

[75] Inventors: Colin Jones, Trenton; William J. Clemens, Plymouth, both of Mich.

[73] Assignee: Ford Motor Company, Dearborn, Mich.

[21] Appl. No.: 689,361

[22] Filed: Jan. 7, 1985

[51] Int. Cl.[4] ..... F02M 9/14

[52] U.S. Cl. ..... 123/472; 261/DIG. 56; 261/DIG. 82; 261/DIG. 39

[58] Field of Search ..... 123/472, 478; 261/DIG. 39, DIG. 55, DIG. 56, DIG. 82, 116

[56] References Cited

U.S. PATENT DOCUMENTS

| | | | |
|---|---|---|---|
| 1,601,453 | 9/1926 | Rayfield | 261/DIG. 56 |
| 1,733,668 | 10/1929 | Leibing | 261/DIG. 56 |
| 1,990,702 | 2/1935 | Leibing | 261/DIG. 56 |
| 4,347,823 | 9/1982 | Kessler | 123/472 |
| 4,501,709 | 2/1985 | Yamamoto | 261/DIG. 56 |

*Primary Examiner*—Ronald B. Cox
*Attorney, Agent, or Firm*—Robert E. McCollum; Clifford L. Sadler

[57] ABSTRACT

A fuel injection system of the single point, throttle body type in which a fuel injector is located centrally above the inlet to an air throttling body that contains a variable venturi consisting of a plug and nozzle assembly wherein the plug includes a fuel dispersion plate directing the fuel towards a movable nozzle together defining a convergent-divergent flow air that is variable in area in response to the dynamic pressure of the air against it at higher air flows or alternately responsive to the suction of the engine at low air flows to be moved to a position providing essentially a constant air velocity flowing past the fuel under all conditions of operation to shear the fuel and thereby atomize the same for an economical and efficient operation of the engine.

8 Claims, 1 Drawing Figure

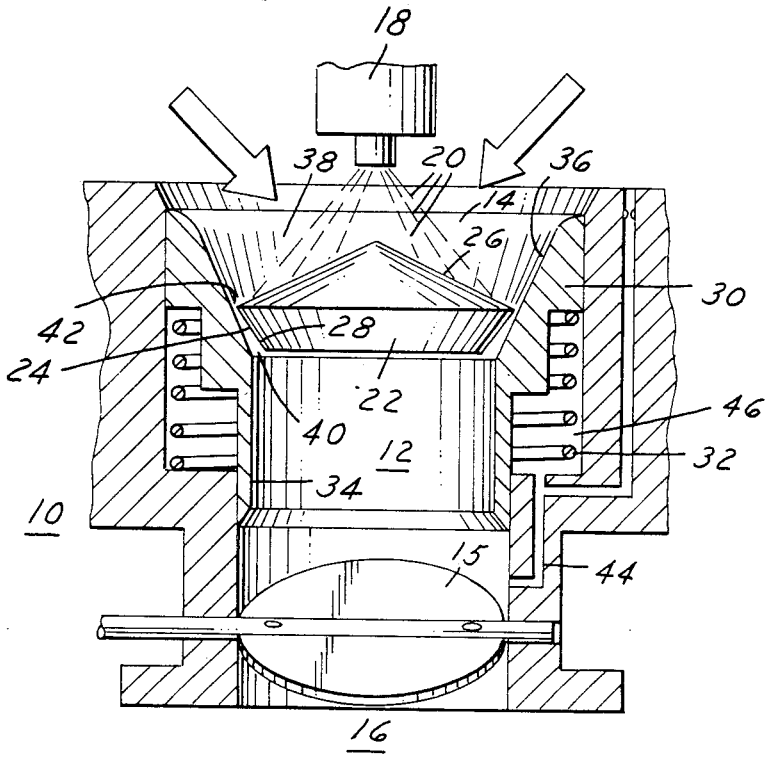
18
38
20
36
14
26
30
42
28
24
22
46
40
12
32
34
10
15
44
16

FUEL INJECTION THROTTLE BODY

This invention relates in general to a fuel injection system, of the single point, throttle body type and more particularly to one including a fuel dispersion member and a movable throttling sleeve valve to cause a shearing of the fuel for atomizing the same for a more efficient and economical operation of the engine.

It is a primary object of the invention to provide and air/fuel throttling body for a fuel injection system of the single point type, that includes an induction passage in which is located a fuel dispersion plate directly beneath the injector, the plate being part of a plug and nozzle assembly together defining a convergent-divergent flow area through which the air and fuel flow, the fuel being sheared by the increased velocity impacted to the air flow to finely atomize the fuel, the nozzle portion of the assembly being axially slidable in response to the dynamic pressure of air flow at higher air flow rates and in response to the vacuum in the induction passage at lower air flows, to a position providing essentially a constant air velocity to the air/fuel charge passing through the C-D nozzle, independent of the position of the conventional throttle valve.

Other objects, features and advantages of the invention will become more apparent upon reference to the succeeding, detailed description thereof, and to the single FIGURE schematically illustrating a cross-sectional view of a throttle body embodying the invention.

The use of fuel dispersion members in connection with a fuel injector, as well as air flow responsive members movable to change air flow areas, is known. For example, U.S. Pat. No. 4,347,823, Kessler, et al, shows fuel distribution skirts consisting of conical members located below the fuel injector for dividing the flow of air. However, the skirts are not movable and the air flow area does not change to provide essentially a constant air velocity independent of the position of the throttle valve.

U.S. Pat. No. 3,994,998, Minneck, shows an axially movable piston located above the conventional throttle valve to define a spring mounted self-regulating venturi, the piston being responsive to air flow to change the area of the venturi and having internal passages for the flow of fuel to the edge of the piston for reaction with the air flow for atomizing the fuel. However, Minneck is a carburetor installation and not a throttle body for use with a single point type fuel injector cooperating with a fuel dispersion plate and a slidable nozzle to provide essentially a constant air velocity to the fuel and air for shearing of the fuel and atomizing the same.

U.S. Pat. No. 4,272,460, Watanabe, et al, shows a variable venturi type carburetor in which a pipe member is connected to the fuel injector to present the fuel at right angles to the air flow for atomizing the fuel. However, the construction does not provide a fuel dispersion plate in cooperation with an axially movable air throttling sleeve to form a convergent-divergent air flow area for atomizing the fuel in the manner of this invention.

U.S. Pat. No. 3,049,342, Hansen, shows a spring biased nozzle sleeve that is responsive to air flow to progressively uncover fuel orifices in proportion to the air flow. There is no fuel dispersion plate or movable nozzle to provide essentially a constant air velocity independent of the throttle valve position.

Referring now to the FIGURE, there is shown schematically therein a portion 10 of an air throttling body having an air/fuel induction passage 12 open at its upper end 14 and adapted to be connected at its lower end 16 to the intake manifold of an internal combustion engine, not shown. The upper end 14 would be located to receive clean air from a conventional air cleaner, not shown, at essentially at atmospheric pressure level. A throttle plate 15 is fixed on a shaft that is mounted in the throttle body for rotation across passage 12 between an essentially closed engine idle speed position and a wide open throttle position, to control the flow through the passage.

A single point type fuel injector 18 in this case is suspended directly above the induction passage 12, by means not shown, over the inlet 14 for the conical spray of fuel therefrom indicated by dotted lines 20. The injector would be centrally located for cooperation with a stationary fuel dispersion member 22 located directly beneath the injector. Member 22 in this case constitutes one-half of a plug and nozzle type assembly together forming a convergent-divergent air/fuel flow area 24 between the two for increasing the velocity of the air and fuel flowing therethrough in a manner to be described.

Member 22 is formed as a segment of a cone with an angled or slanted upper surface 26 and a converging annular bottom portion 28. The nozzle portion consists of a sleeve 30 axially movably mounted in induction passage 12 on a spring 32 seated against a step in the throttle body. The sleeve has a generally cylindrical lower guide portion 34 and a converging air flow controlling portion 36. Together the plug-like fuel dispersion member 22 and the sleeve 30 form a converging annular air and fuel inlet path 38 and a diverging annular exit path 40 with an annular throat section 42 of minimum cross-sectional area therebetween. The nozzle and plug, therefore, in effect form a variable venturi that increases the velocity of the air and fuel flow through the C-D path to shear off the fuel flowing down the surface 26 to its outer edge and thereby atomizing the same.

The axially movable sleeve 30 in this case is self-regulating in position to maintain essentially a constant air velocity to the flow of air through the C-D path. More specifically, a passage 44 in the throttle body connects the space between the throttle valve or plate 15 and member 22 to a chamber 46. The chamber is formed between the sleeve 30 and throttle body 10 and contains a spring 32. At low air flows, when the throttle plate is essentially closed, the vacuum in the induction passage transmitted to below the sleeve 30 will oppose the force of spring 32 and pull the sleeve 30 down and away from the dispersion plate 22. This provides a controlled flow area between the sleeve and dispersion plate where the fuel is sheared off by the high velocity air flow through the C-D path. At higher air flows, when the throttle valve or plate is opened progressively, the increased dynamic pressure of the air against the converging portion 36 of sleeve 30 further opens the sleeve against the force of spring 32 to maintain essentially the same air velocity at the throat area 42 without undue restriction through the throttle body. The sleeve thus moves to a self-regulating position under both low and high air flow conditions providing essentially a constant air velocity to the air and fuel flowing through the opening 24 independently of the throttle valve position.

From the foregoing, it will be seen that the invention provides a variable venturi type of air throttling body in cooperation with a single point type fuel injector, the venturi automatically being enlarged to a flow area providing essentially a constant air velocity for shearing of the fuel to atomize the same and thereby provide an efficient and economical engine operation.

While the invention has been shown and described in its preferred embodiment, it will be clear to those skilled in the arts to which it pertains that many changes and modifications may be made thereto without departing from the scope of the invention.

We claim:

1. An engine air/fuel throttling body having an induction passage open at an air inlet end and connected to the engine intake manifold at the opposite end, a throttle valve mounted for a rotatable movement across the passage to control flow therethrough, a fuel injector mounted above the air inlet for the spray of fuel thereinto, and a variable flow area, convergent-divergent (C-D) plug and nozzle assembly in the passage beneath the injector for increasing the air velocity to atomize the fuel, the assembly including a plug member having a fuel deflecting surface beneath the injector and a nozzle member surrounding and cooperating with the plug member defining a minimum cross-sectional throat area therebetween, the C-D flow area increasing the velocity of the air at the throat area to shear the fuel from the adjacent plug surface to thereby atomize the fuel, one of the members being movable relative to the other by the air flow thereagainst at higher engine air flow rates and alternatively by engine vacuum at lower engine air flow rates to a self-regulating position providing essentially a constant air velocity to the air flowing through the throat area.

2. A body as in claim 1, wherein the fuel deflecting surface is angled downwardly to direct the fuel toward the throat area.

3. A body as in claim 1, wherein the plug member includes successive diverging and converging portions defining an annular edge forming the internal part of the throat area, the fuel deflecting surface being defined by the diverging portion and directing the fuel toward the edge for the shearing off of the fuel therefrom by the air passing through the throat area.

4. A body as in claims 1 or 3, wherein the nozzle member is axially movable relative to the plug member, and spring means biases the nozzle member axially upwardly towards the plug member.

5. A body as in claim 1, wherein the plug member is stationary and essentially a segment of a cone to direct fuel from the surface toward the throat area, the lower portion of the cone being tapered radially inwardly to define with the nozzle member the diverging portion of the C-D flow area.

6. A body as in claim 5, wherein the nozzle member consists of an axially movable cylindrical sleeve having a converging annular air inlet portion.

7. A body as in claim 1, the nozzle member being axially movable relative to the plug member in response to the dynamic pressure of the air flow thereagainst at higher air flows and open throttle valve positions, spring means biasing the nozzle member towards the plug member, and means connecting the nozzle member to the vacuum in the induction passage at a location between the plug member and throttle valve for moving the nozzle member downwardly in opposition to the spring means also at low engine air flow conditions and smaller throttle valve openings.

8. A central fuel injection type fuel feed system for an automotive type internal combustion engine including an air/fuel throttle body having an air/fuel passage therethrough open at one end to air essentially at an atmospheric pressure level and adapted to be connected at its opposite end to the intake manifold of the engine to subject the passage to the varying vacuum levels therein, a throttle valve rotatably mounted in the passage for movement between open and closed positions controlling the flow of air and fuel through the passage, a fuel injector means concentrically positioned in the passage above the throttle valve for discharge of fuel into the passage in an axial direction with a conical-like spray pattern, a plug-like stationary fuel dispersion plate located directly beneath and in the path of fuel discharged from the injector, the plate having angled surfaces directing the fuel injected thereagainst to flow towards the walls of the passage, and an axially movable nozzle-like sleeve type throttling valve in the passage surrounding the plate and cooperating with the edge thereof to variably control the flow of air and fuel into the passage, the valve and plate together defining a convergent-divergent (C-D) variable flow area between that increases the flow velocity of the air passing therethrough to shear off fuel directed to the edge of the plate to thereby atomize the fuel, the nozzle being movable axially in response to the dynamic pressure of the flow of air thereagainst at higher engine air flows upon opening of the throttle valve and also movable at lower air flows by the engine vacuum acting thereon to a self-regulating position providing essentially a constant velocity to the air flow through the C-D area.

* * * * *